United States Patent [19]

Buchko et al.

[11] Patent Number: 4,897,985

[45] Date of Patent: Feb. 6, 1990

[54] CONTINUOUS MOTION PACKAGE FORMING MACHINE

[75] Inventors: Raymond G. Buchko, Appleton; John A. Halgren, Neenah, both of Wis.

[73] Assignee: Curwood, Inc., Appleton, Wis.

[21] Appl. No.: 254,412

[22] Filed: Oct. 6, 1988

[51] Int. Cl.[4] ..... B65B 9/02; B65B 65/02

[52] U.S. Cl. ..... 53/559; 53/553; 83/324

[58] Field of Search ..... 53/559, 553, 548, 209, 53/203; 83/324

[56] References Cited

U.S. PATENT DOCUMENTS

| | | | |
|---|---|---|---|
| 3,129,545 | 4/1964 | Sloan et al. | 53/553 X |
| 3,782,072 | 1/1974 | Sorensen etal. | 53/553 X |
| 3,928,941 | 12/1975 | Singer | 53/553 |
| 4,453,436 | 6/1984 | Tokuno | 83/324 X |
| 4,617,850 | 10/1986 | Bishop | 83/324 |

*Primary Examiner*—James F. Coan

*Attorney, Agent, or Firm*—Lee, Mann, Smith, McWilliams & Sweeney

[57] ABSTRACT

A continuous motion packaging machine which forms packages from overlying webs advanced along a path at a constant speed. A tooling carriage traverses a repetitive path which includes an "on-line" increment during which the tooling carriage matches web movement and package operations are performed. The tooling carriage is driven by linkage including a power input shaft operated at varying speeds throughout each cycle to maintain carriage position relative to the webs. Two brushless servo motors are used. One drives the webs, the other drives the tooling carriage. A computer program compares relative motor positions at points throughout each cycle to a pre-established position pattern and adjusts motor controller output to maintain one motor position relative to the sensed position of the other motor.

10 Claims, 6 Drawing Sheets

CONTINUOUS MOTION PACKAGE FORMING MACHINE

BACKGROUND OF THE INVENTION

This invention relates to a continuous motion packaging machine which forms packages from continuously advancing webs. More particularly, it relates to such a machine which includes a moveable tooling carriage which transcribes a repetitive path including an increment during which package forming operations are performed on a section of the advancing webs.

The package formed by the packaging machine of the present invention is formed of plastic laminate film. Numerous types of packaging machines exist which produce such packages. Many are indexing types, in which the web is advanced incrementally to a series of stations where package forming tooling operates upon the webs.

Other machines have been designed which permit a continuous motion of the web. Two known machines are the Flex-Vac 618 and the Mahaffey 301. Each utilizes generally reciprocal tooling carriage driven by a input shaft rotating at constant speed. Various cams, followers, levers, and rockers are employed to direct carriage movement.

The present invention provides a machine which eliminates the need for such machine elements and the associated noise, wear characters and maintenance requirements, yet accomplishes continuous motion packaging.

SUMMARY OF THE INVENTION

The packaging machine of the present invention forms individual packages of contained product from overlying webs which advance at a constant speed through a processing zone.

A moveable tooling carriage traverses a repetitive closed loop cycle which includes an "on-line" increment during which the movement of the carriage matches the advancement of the web to perform packaging operations. The carriage is driven by linkage including power input shafts driven at varying speeds throughout the cycle.

The webs are driven at constant speed by a brushless servo motor. The tooling mechanism is driven by another brushless servo motor. A computer program compares motor positions to a predetermined positional relationship between the motors at numerous comparison points throughout the cycle and varies power input to the linkage drive motor to match its position to that of the web drive motor.

The carriage linkage drive control arrangement has utility apart from the packaging machine environment. It is effective to provide controlled repetitive cycle movement of one function relative to another in any application where such control is required. It is contemplated that other parameters such as motor speed could be monitored and adjusted without departing from the invention.

DETAILED DESCRIPTION OF THE DRAWINGS

DETAILED DESCRIPTION OF ILLUSTRATED EMBODIMENT

Figure 2:
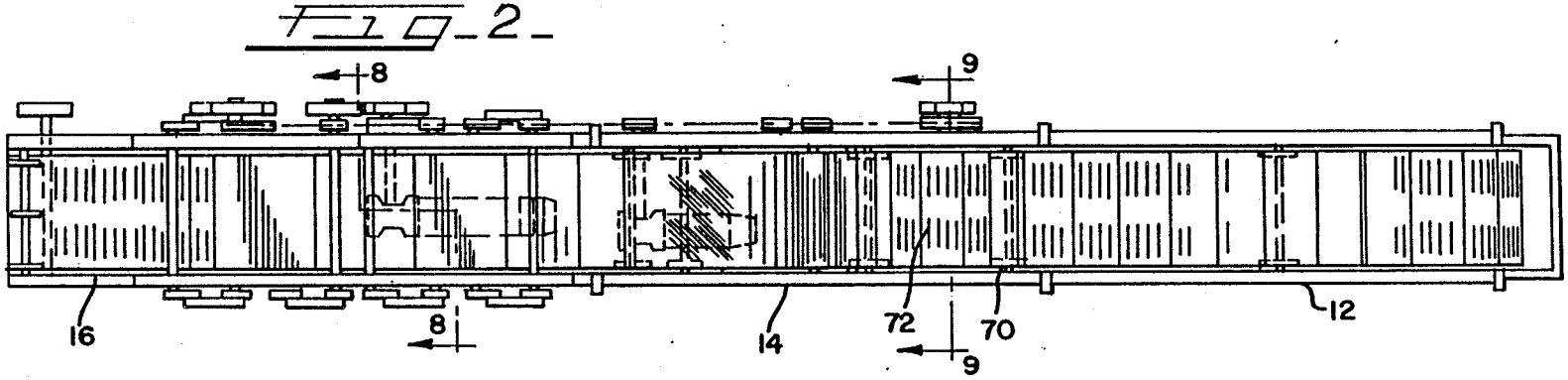
FIG. 2 is a top view of the packaging machine of FIG. 1.

Referring now to the drawings, there is shown an embodiment of a continuous motion top and bottom web packaging machine incorporating the principles of the present invention. The package formed by the packaging machine of the present invention is a sealed and evacuated packet which contains a quantity of product. It is formed of two separate plastic laminate films, each of which is usually formed to partially surround the product and joined together to define the complete package. It should be understood that the particular package and product are purely for illustrative purposes. The packaging machine is adaptable to package any product for which evacuated plastic film packaging is desirable. The number of product units per package and the shape of depressions in one or both of the films for receiving the product is also optional, dependent upon the packaging objective. These various alternatives are all within the scope of the invention.

Figure 1:
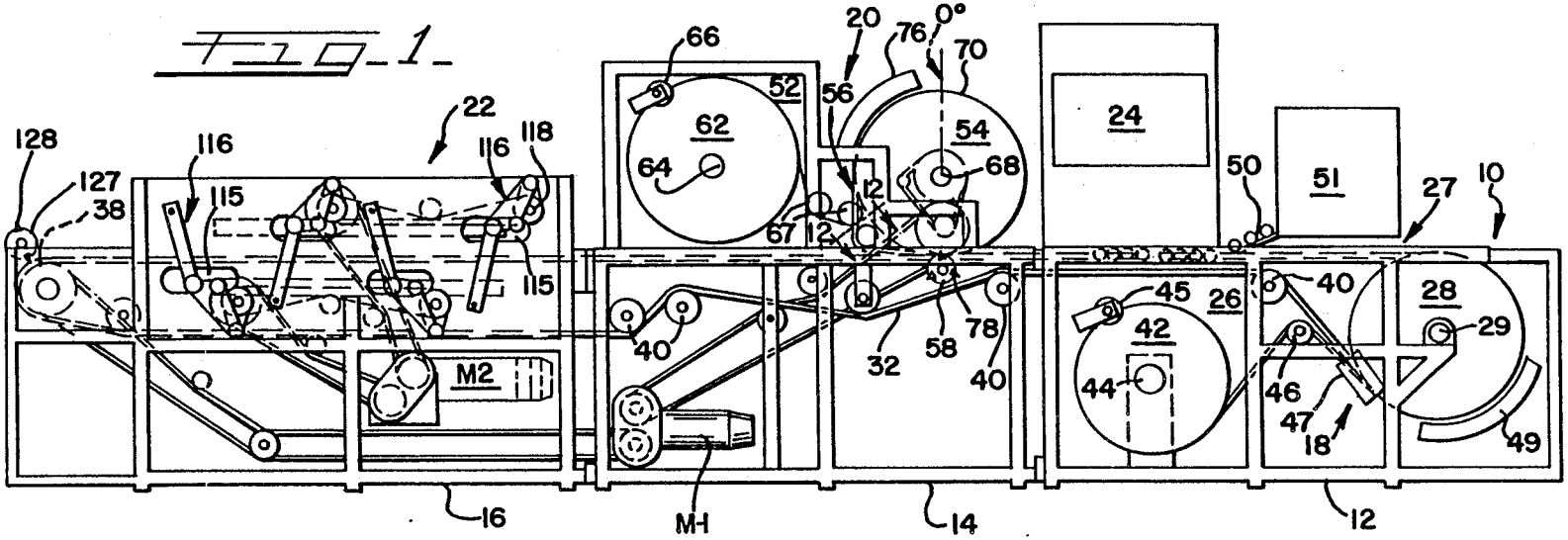
FIG. 1 is a plan view of a packaging machine incorporating the principles of the present invention.

As best seen in FIGS. 1 and 2, the packaging machine 10 includes separate, connected frame sections 12, 14, and 16. This framework supports a lower web forming and carrier arrangement, generally 18, an upper web forming and supply section, generally 20, a package sealing mechanism, generally 22, and a control station 24. Control station 24 houses electronic processors which operate the separate machine elements in synchronization to produce the finished packages as will be more fully explained.

The machine 10 is categorized as a continuous motion, top and bottom forming machine. Continuous motion means that the webs move at a constant speed through a processing zone, rather than indexing incrementally along a path. The web is unsupported in that the lower or bottom web carries the weight of the product through the processing zone. Two webs are used to form the package, a bottom web and a top web, which is disposed in overlying relation to the bottom web after product is delivered to the web. Further processing of the webs thereafter results in formation of individual hermetically sealed packages.

The webs may be of any plastic film suitable for heat and vacuum forming and protection of product such as foodstuffs. One or both films may be coated or laminated to provide particular sealing or opening capabilities.

Machine 10 advances a continuous lower web of plastic film at constant speed along a horizontal processing zone, generally 27, commencing at frame section 12, and terminating at the free end of section 16. Product is disposed upon the lower web at section 12. A continuous upper web is advanced and placed in overlying relation to the lower web at section 14 by upper web forming and supply section 20. Further processing steps are performed upon the joined webs by package sealing mechanism 22 and completed packages exit the horizontal processing zone at the free end of section 16.

Lower web forming and carrier arrangement 18 comprises a lower web supply station 26, a rotatable lower web forming drum or turret 28 and a lower web conveyor system . The conveyor system, best seen in FIGS. 1 and 9, includes a pair of spaced apart continuous chains 32, provided with closely spaced web clamps 34. Chains 32 travel a continuous path shown in FIG. 1, about sprocket teeth formed on turret 28, along horizontal processing zone 27, across machine frame sections 12, 14 and 16, about drive sprockets 38, and back to turret 28.

Figure 9:
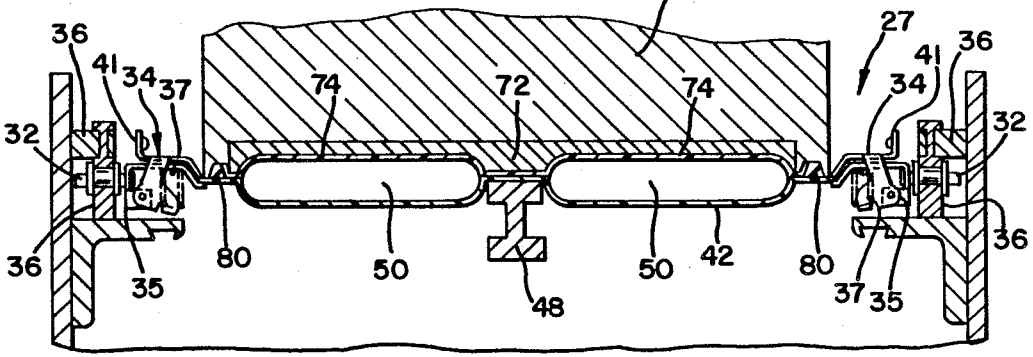
FIG. 9 is a sectional view of the apparatus of FIG. 1 taken along the lines 9—9 of FIG. 2.

As best seen in FIG. 9, chains 32 are guided along path 27 by chain guide and support rails 36 attached to the upper end of frames 14, 16 and 18. The rails 36 are spaced apart a distance greater than the width of the lower web and support and guide the chains. The rails also retain the chains from movement toward each other. The return path is defined by a plurality of idler sprockets 40 which provide appropriate tension in the chains. Drive sprocket 38 moves the chains 34 at a constant speed.

Clamps 34 may be of any suitable configuration to receive and carry a web from the supply station 26 along the horizontal processing zone 27 for purposes of the packaging operation. An example of one such clamp is found in application Ser. No. 254,413 for U.S. Patent entitled "Clamping Arrangment For Gripping And Carrying Web Material" filed contemporaneously herewith in the names of inventors Raymond G. Buchko and John A. Halgren, and assigned to a common assignee. The disclosure therein is hereby incorporated by reference into this application.

As best seen in FIG. 9, clamps 34 include a lower jaw 35 carried by the chain 32. Upper jaw 37 is pivotally attached to lower jaw 35. The jaws each include gripper teeth biased into a gripping relationship by a spring. Upper jaws 37 include an operator lever 41 to pivot the jaw relative to lower jaw 35 to open the teeth to receive web 42.

Lower web supply station 26 houses a roll of plastic laminate film or web 42, upon a shaft 44. A lower web guide 45 is biased into guiding contact with the roll and insures alignment of the web 42 as it is removed from the roll.

Web 42 passes over guide roll 46 and is fed into a web attachment mechanism generally designated 47, which include camming bars which engage levers 41 to open clamps 34 to receive the opposing transverse edges of the webs. As the clamps pass from the mechanism 47, the clamps close and grip web 42 and carry it about turret 28 and along horizontal processing zone 27. As best seen in FIG. 9, the chains travel along within chain guide rails 36, and lower web 42 is centrally supported by a support rail 48.

Lower web forming turret 28 rotates on shaft 29. It is driven by engagement of the chains 32 with the sprockets formed on the periphery of the turret.

Lower web forming turret 28 has a generally cylindrical outer surface. That surface includes a plurality of die sets which impart shaped depressions into the web 42 by a heat and vacuum process. The depressions are shaped at about one-half thickness of the product to receive hot dogs in groupings of four. The dies are arranged to form two such groupings in side-by-side relation across the axial width of the web 42.

The interior of the turret is connected to appropriate cooling and vacuum mechanisms to accomplish web shaping. A heating mechanism 49 is closely spaced from lower turret 28, which heats film on web 42 as it passes between the heater and the dies carried by turret 28. In the embodiment illustrated, the formed lower web advances from turret 28 along horizontal processing path 27 and product, here depicted as hot dogs, 50, is deposited into the formed shapes in the web by a product supply mechanism generally designated 51. The web continues to advance along the path 27 with the upper halves of the product exposed above the surface of the web 42.

Upper web forming and supply mechanism 20 advance and form a continuous web of plastic film and deposits it upon the lower web in overlying relation to the product. Mechanism 20 is supported upon frame section 14 and includes upper web supply station 52, rotatable upper web forming turret 54, and web retention and advancement mechanism 56. A web joining bar mechanism 58 is disposed below the bottom of bottom web 42, which seals the webs together at spaced intervals for further processing as will be explained.

Upper web supply station 52 houses a roll of plastic laminate film 62 upon a shaft 64. An upper web guide 66 is biased into guiding contact with the roll and insures alignment of the web 62 as it is removed from the roll. Web 62 passes about one or more guide rolls 67 and is received and retained on turret 54 by the web retention and advancement mechanism 54.

The upper web forming drum or turret 54, best seen in FIGS. 1 and 9, rotates on shaft 68. Turret 54 rotates in a clockwise direction as viewed in FIG. 1 and delivers an upper or top web to the processing zone 27 from the bottom of the drum 54 in the same direction of movement on the advancing lower web 42. The drive is synchronized to rotate the upper turret 54 so as to supply the upper web 62 at a constant speed equal to the speed of advancement of lower web 42 along path 27. Relative positions of each web is also synchronized such that the package portions formed on each web mate with each other as the webs are joined.

Upper web forming turret 54 imparts package shapes into the advancing web 62 by the vacuum forming process. The interior of turret 54 is connected to appropriate cooling and vacuum forming mechanisms to accomplish the web shaping.

Turret 54 includes an outer generally cylindrical surface 70 upon which are disposed plural forming dies 72. A heater 76 is closely spaced from upper web forming turret 54. Web 62 passes between turret 54 and heater 76 and is heated by radiant heat during the forming process.

In the embodiment illustrated, and as shown in FIG. 9 the turret forming dies 72 includes depressions 74 defining pockets to receive hot dogs in groups of four. The depressions are a depth of about one-half the thickness of the product to be packaged. The dies each include two sets of depressions 74 spaced side-by-side axially of the turret 54 to form two packages simultaneously across the web width. Fifteen such dies are positioned about turret 54. It should be noted that the configuration and disposition of forming dies 72 of upper turret 54 is typical of the die set configuration and disposition on the lower turret 28. As best seen in FIG. 1, turret 54 is disposed relative to horizontal processing zone 27 such that the lower web 42 is essentially tangent to the generally circumferential surface 70 of the turret.

Referring to FIG. 9, lower web 42, clamped between clamps 34 and supported mid-web by web support rail 48, advances along horizontal path 27 as a result of the continuous movement of chains 32 from lower turret 28 toward drive sprocket 38. Product 51 protrudes about one-half of its thickness from the depressions formed in the lower web by lower turret 28. As continuously advancing lower web 42 passes tangency with upper die turret 54, upper web 62 is deposited upon lower web 42. The depressions formed in upper web 62 conform to the upper half of product 50 and are placed over the exposed product as it passes under the turret 54.

Web joining bar mechanism 58 is disposed below lower web 42. Its function is to join upper and lower webs 62 and 42 together after upper web 62 has been positioned in overlying relation to the lower web in encasing relation to product 50. Mechanism 58 includes a rotatable drum disposed below web 42 and provided with a plurality of heater bars 78 which extend transverse to the webs. The bars include contact edges which are heated to a predetermined temperature suitable to seal the web materials together.

Web joining bar, powered by motor M-1, is rotated in synchronization with the advancement of web 42. Contact heater bars come in contact with the underside of lower web 42 between each group of package depressions 74. Bar contact with web 42 is made when the upper turret 54 is in a position such that the bar contacts the webs between depressions 74 and urges upper web 62 into contact with surface 70 of turret 54 to provide support for the webs as bar 78 heat seals the webs together.

Web retention and advancement mechanism 56 retains upper web 62 upon surface 70 of upper turret 54 for an arc of its rotation to permit forming of the web and to advance the web to the processing zone 27. Any suitable web retention and advancement mechanism can be used on the turret 54. It is only necessary that the mechanism retain the web 62 on turret 54 during web forming and deliver the web to the advancing lower web 42 in proper register with the package depressions 74 and product 50 for further processing.

Figure 12:
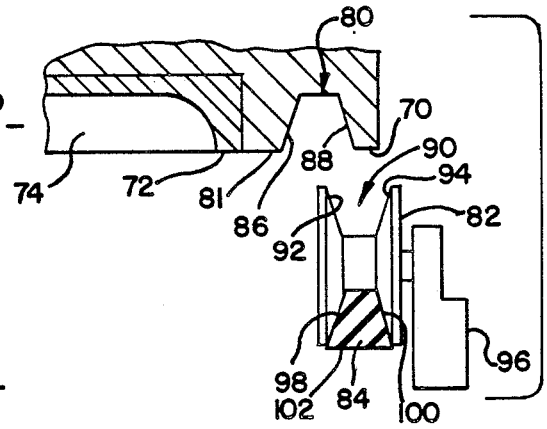
FIG. 12 is a fragmentary sectional view of a portion of the apparatus of FIG. 1 taken along the line 12—12 of FIG. 1.

Mechanism 56 as shown in FIG. 12 and disclosed in copending application Ser. No. 254,432 filed concurrently herewith includes a pair of parallel retention grooves 80 formed about cylindrical surface 70 of turret 54, a pair of belt guide pulleys 82 spaced from the turret and a pair of endless belts 84 each one of which travels in one groove 80 and about one pulley 82. The grooves 80 are formed in the outer cylindrical surface 70 of turret 54 adjacent its transverse ends outward of die sets 72. Grooves 80 are of inverted trapezoidal cross section and are defined by inner annular walls 86 and outer annular walls 88 which converge radially inwardly from surface 70. The axial distance between inner edges 81 of grooves 80 is slightly less than the transverse width of web 62.

Pulleys 82 have grooves 90 of trapezoidal cross sections similar to the grooves 80 in turret 54. The grooves 90 are defined by inner and outer annular walls 92 and 94 which converge radially inwardly. Pulleys 82 are rotatably supported on tension arms 96 biased away from turret 54 so as to maintain tension on belts 84. Arms 96 are positioned such that inner annular wall 92 of each pulley 82 is spaced axially outward of inner edge 81 of associated groove 80 and, therefore, axially outward of inner annular wall 86. The axes of rotation of pulleys 90 are generally parallel to the axis of rotation of turret 54.

Endless belts 84 are of a trapezoidal cross-section to mate with the grooves 80 in turret 54 and grooves 90 of tensioning pulleys 82. Each belt includes an inner annular surface 98 and an outer annular surface 100 which converge from an outer surface 102 of the belts. The belts, preferably made of urethane, are of a length sufficient to pass about the turret grooves and tensioning pulleys.

The pulleys 82 are positioned a distance from turret 54 sufficient to cause belts 84 to engage the grooves 80 for an arc less than the entire circumference of the generally cylindrical surface 70. As best seen in FIG. 1, belts 84 are disposed in grooves 80 for about 270 to 280 degrees of the turret circumference.

As best explained with reference to FIG. 12, the path of travel of the belts 84 from pulleys 82 to grooves 80 of turret cylindrical surface 70 is convergent toward the entrance to grooves 80. The path of the belts 84 from their exit from grooves 80 to contact with pulleys 90 is divergent toward the pulleys 90. Between the point of entrance into grooves 80 and exit from grooves 80, the belt is disposed within the groove 80 with inner and outer annular surfaces 98 and 100 of the belt are in contact with inner and outer walls 86 and 88 of grooves 80.

The pulleys are positioned such that the belts 80 travel a generally vertical path from pulleys 90 to grooves 80 and are tangent to the grooves at about the 270 degree position of the turret. (As shown in FIG. 1, vertical is zero degrees.) During the entry of belts 84 into grooves 80, the relative motion of inner annular surfaces 98 of belts 80 and inner annular walls 86 of grooves 80 is an axial closing action with surfaces 98 moving axially toward inner annular walls 86.

Belts 84 commence to exit grooves 80 slightly after the tangency of turret 54 with horizontally disposed lower web 42 or about 80 to 90 degrees from the entrance of the belts into contact with groove surfaces 86 and 88. During exit of the belts 84 from grooves 80, the relative motion of inner annular surface 98 of belt 80 and inner annular walls 86 of grooves 80 is a separating action with surface 98 moving axially from inner annular wall 86. As the belts converge toward the turret 54, inner annular surfaces 98 grasp edges of web 62 and urge them into grooves 82. During the arc of travel in which the belts 84 are fully disposed in grooves 80, the belts and groove walls travel at the same speed. No relative movement between the belts and the grooves occurs. The web is thus retained upon the surface 70 for the arcuate portion of revolution of turret 54 that the belts engage the grooves 82. At about the 180 degree position of turret 54, the surface 70 is tangent to lower web 42. At this location, belts 84 release the web edges. At the same time, bar 78 seals the two webs together along a transverse line and the webs advance together for further processing.

Package sealing mechanism 22 is positioned on frame section 16. It is illustrated in FIGS. 1, 3 to 6, 8 and 10. This mechanism performs operations upon the advancing webs 42 and 62 to complete individual packages of contained product.

The mechanism 22 includes a pair of moveable tooling carriages 110 which carry tooling 112, and which are supported on main vertical walls 114 by operating linkages 116. Linkages 116 are operated by plural cross shafts 118 driven in a manner as will be explained.

Figure 10:
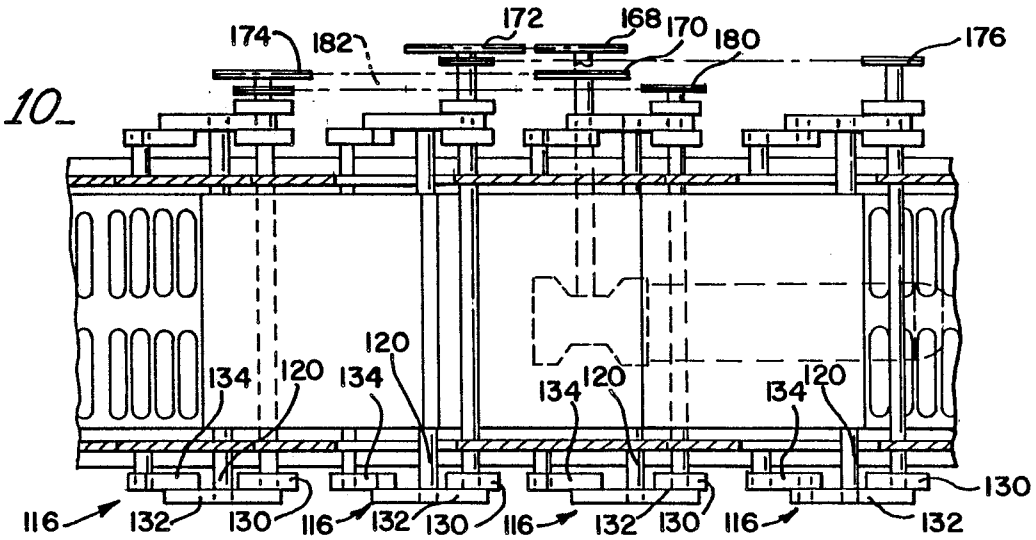
FIG. 10 is a fragmentary top view, partially schematic, of the package sealing mechanism illustrated in FIGS. 3 to 6.

Vertical walls 114 are major structural elements which carry the load of moveable tooling carriages 110. Formed of steel plates and positioned on either side of webs 42 and 62, these walls extend longitudinally of processing zone 27. The walls support the linkages 116 and cross shafts 118. As seen in FIGS. 1 and 10, the linkages 116 are disposed on the exterior of walls 114. Apertures 115 are formed in the walls to accommodate connection of the linkages to carriages 110.

Tooling carriages 110 are disposed between walls 114 in cooperating relation to each other, above and below the webs 42 and 62. The carriages are connected to linkages 116 by support rods 120. In operation, linkages 116 cause carriages 110 to travel in a repetitive cyclic path which includes an increment of travel in the same direction and at the same speed as the webs. During this increment, carriages are closely spaced from the webs and tooling 112 is operative to act upon the webs.

The tooling 112 includes three separately functioning apparatus, initial seal 112A, evacuation and final seal 112B, and transverse web separation 112C. The tooling is sized to act upon a segment of webs which, in the direction of web movement, is the length of three groups of packages, two packages wide. The path of carriage movement is configured and timed such that, on repetition of the cycle, the tooling 112A engages the next adjacent segment of webs 42 and 62. The segment acted upon by tooling 112A during one cycle advances to tooling 112B during the next immediate cycle and that segment advances to operative association with tooling 112C during the next cycle.

Figure 8:
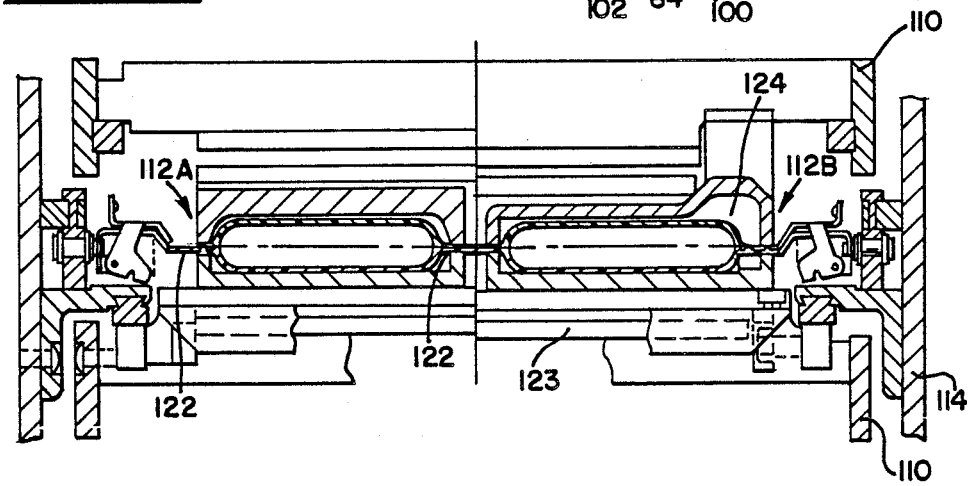
FIG. 8 is a split, fragmentary sectional view of the apparatus of FIGS. 1 and 2 taken along the lines 8—8 of FIG. 2 showing alternative positions of portions of the package sealing mechanism.

Referring to FIG. 8, there is ilustrated section of tooling 112A and 112B. The upper carriage tooling is shown above web 62 and the lower carriage tooling is shown below web 42. Appropriate heating, vacuum and power connections are made to the tooling from above and below carriages 110. The tooling is carried upon air cylinders 121 illustrated in FIGS. 3 and 6 which move the tooling toward and away from webs 42 and 62 to accommodate the carriage path of movement and to clamp the webs between the tooling as required. As shown in FIG. 8, lower walls 110 support horizontally extending limit rails 123 below web 42 in machine section 16. Lower tooling 112 includes rollers 125. When lower tooling carriage 110 is in the appropriate portion of its cyclic path for the tooling to advance toward the webs, air cyclinders 121 drive tooling 112 into position determined by the rolling engagement of rollers 125 with rails 123. This action defines the upper limit of travel of lower tooling 112. Upper tooling 112 is caused to move downwardly to engage the webs. Its downward movement is limited by the position of the lower tooling.

Tooling 112A heat seals webs 42 and 62 together at 122 in a pattern that surrounds depression 74 and products 50. A small, unsealed portion is allowed to remain. Tooling 112B evacuates the package in chamber 124 and completes the hermetic seal across the portion unsealed by tooling 112A.

Tooling 112C comprises transverse slitting knife mechanisms 126 best seen in FIGS. 3 to 6. During each cycle, knife mechanism 126 traverses the webs in one direction and slits the webs into segments one package long in the direction of such movement. These segments remain supported by clamps 34 and are advanced by continuously moving chains 32 for final separation by slitter 127 shown in FIGS. 1 and 2. Slitter 127 may be separately powered by a electric motor mounted on frame 16. It includes three rotating knife blades 128 which separate the formed packages from each other and from the web gripped in clamps 34. The scrap represented by the web strip which remains in the clamps is removed in web attachment mechanism 47 which opens clamps 34 to receive a new web supply.

Linkages 116 support and drive carriages 110 through the support shafts 120. Two pairs of linkages 116 support each carriage 110. One linkage of each pair is disposed on the exterior of each of walls 114. Each pair is connected by a cross shaft 118. Each cross shaft extends through rotatable support bearings on walls 114. As seen in FIGS. 1 and 3 to 6, the cross shafts that drives the upper carriage are above the webs 62 and 42 and the cross shafts that drive the lower carriage are below the webs. It should be noted that the path of movement of the lower carriage is the mirror image of the cycle movement of the upper carriage. The linkages 116 which support and drive the lower carriage are, therefore, inverted relative to the linkages which support and drive the upper carriage.

Referring to FIGS. 3 to 6, linkages 116 each include a crank arm 130 fixed to a cross shaft 118, a triangular connector link 132, and a pivot arm 134. Pivot arm 134 includes an end pivotally supported on vertical wall 114 at 136 and an opposite end pivotally connected to connector link 132 at 138. An opposite end of connector link 132 is rotatably connected to crank arm 130 at 140. Connector link 132 also includes pivotal connection 142 to a support rod 120 of carriage 112. Pivot 142 is displaced from a line drawn between pivot 138 and rotatable connection 140 to crank 130 to define the triangular configuration of link 132. Since cross section shaft 118 about which crank arm 130 rotates and pivot connection 136 of pivotal link 134 are fixed to wall 114, a line between the axis of shaft 118 and pivot 134 represents a fourth link. The linkage 116 is, therefore, a form of a four bar linkage.

Carriages 110 move in a closed loop cycle path to engage tooling 112 with a segment of the advancing webs 42 and 62 for an increment of the cycle. During the period of tooling engagement, carriage movement matches web advancement and no relative movement occurs between the carriages and the webs. During the remainder of the cycle, tooling carriages 110 return to a beginning position to repeat the cycle upon the next adjacent segment of advancing web. Tooling 112 faces downward in upper carriage 110 and contacts web 62. Tooling 112 faces upward in lower carriage 110 and contacts web 42.

Figure 7:
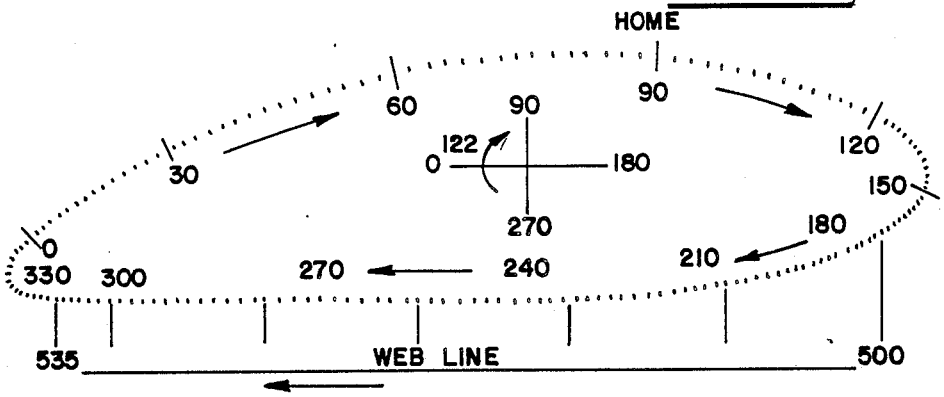
FIG. 7 is a chart illustrating features of the mechanism of FIGS. 3 to 6.

The path of each carriage is illustrated in FIG. 7 as a representation of the movement of a point on the upper carriage. The paths of the lower carriage would, of course, be inverted relative to FIG. 7. The vertical axis of the chart reflects the relative movement of the carriage toward and away from the webs. Movement of the carriage and the webs is indicated by the arrows. Angular position of crank arm 130 is shown in the center of the chart. Its position is correlated to the path of the carriage in degrees of rotation relative to zero degrees which is horizontal, to the left.

The period of tool engagement with the webs may be termed the "on-line" increment of the cycle. The remainder of the cycle may be divided into three increments, the disengagement increment, the return increment, and the engagement increment.

The "on-line" increment of the cycle commences at the point designated 500. The "on-line" increment terminates at a point designated 535. During this increment, the tooling carriage progresses from point 500 to point 535 at a constant speed, matched with the speed of travel of webs 42 and 62. At point 535, carriage 110 enters the disengagement increment and commences to return to the starting point.

Engagement of the tooling with webs commences at a position at the right hand end of walls 114 as viewed in FIG. 1, and during "on-line" engagement tooling carriages advance to the left in unison with the moving webs 42 and 62. During the remaining increments of the cycle, the carriage moves in a generally elliptical path away form webs 42 and 62 and back to the beginning position. This pattern of movement provides smooth transition between increments and minimizes loads on the operating mechanism.

Figure 3:
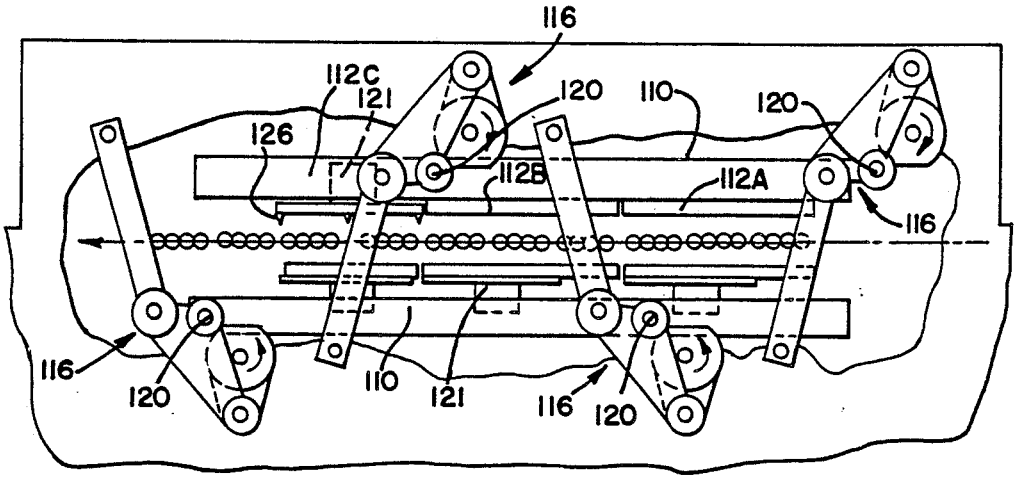
FIG. 3 is a fragmentary partially broken away plan view on an enlarged scale of package sealing mechanism of the present invention.
Figure 4:
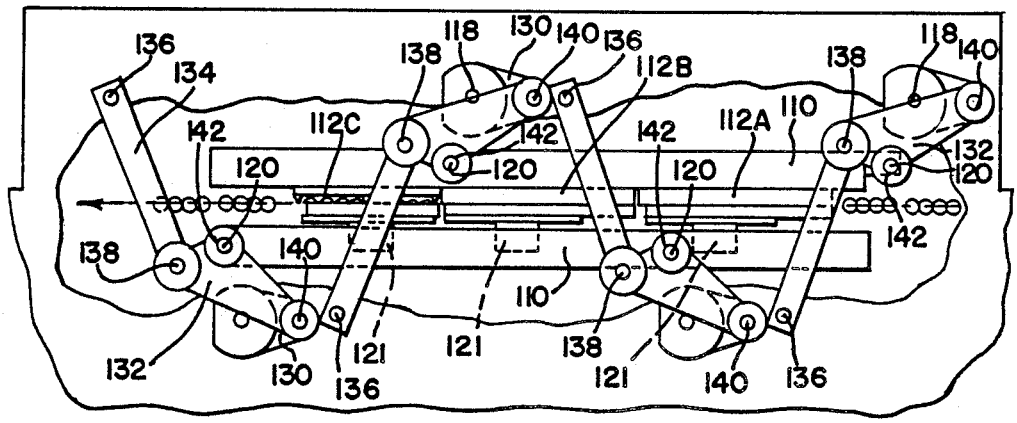
FIGS. 4–6 are views similar to FIG. 3 showing the mechanism of FIG. 3 in different positions of operation.
Figure 5:
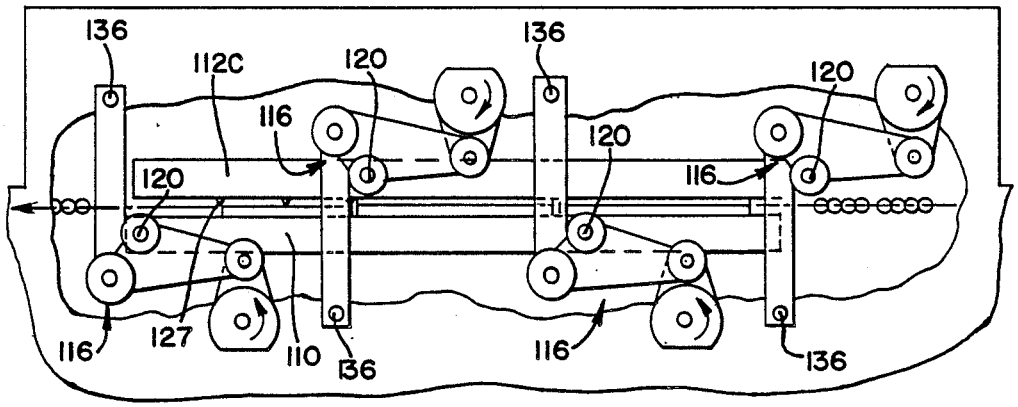
Figure 6:
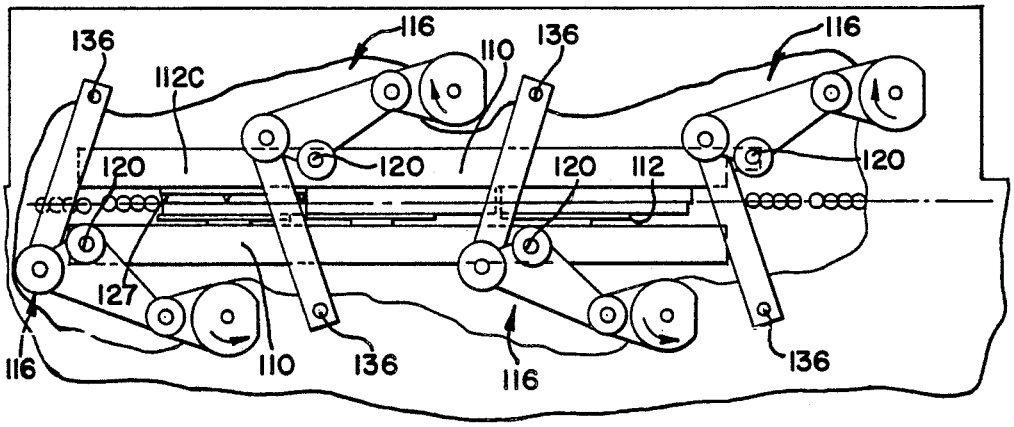

FIG. 6 shows the linkages 116 position of carriages 110 with the crank arm 130 at zero degrees. FIGS. 3, 4 and 5 respectively show the position of the linkages 116 and carriages 110 at 90, 180 and 270 degrees of rotation of the crank arm.

Continuous motion packaging machine 10 is powered by two brushless servo motors M-1 and M-2. These motors are controlled by control station 24 as will be explained.

Figure 11:
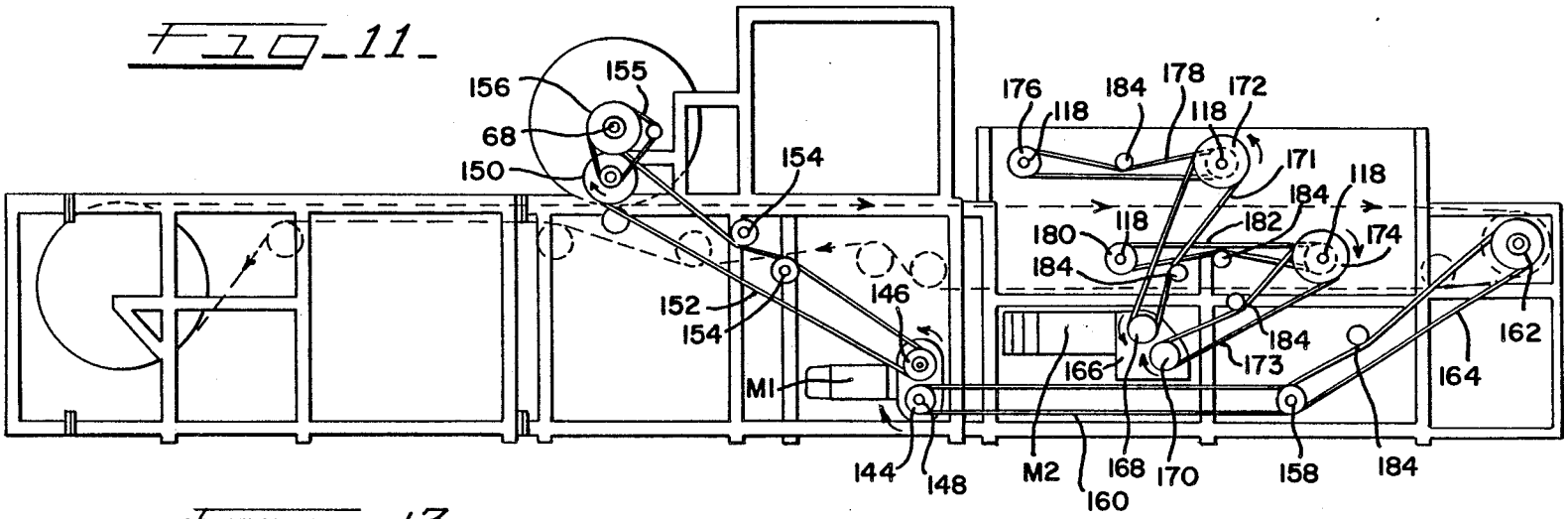
FIG. 11 is a plan view of the packaging machine of FIG. 1 taken from the opposite side and illustrating features of the drive mechanism.

As illustrated in FIG. 11, motor M-1 includes a gear reduction box 144 having two output shafts to which are connected sprocketed output drive hubs 146 and 148.

Output hub 146 is in driving engagement with hub 150 associated with upper web forming turret 54 through toothed drive belt 152. Tension pulleys 154 maintain proper tension on belt 152. Hub 150 in turn drives hub 156 mounted on shaft 64 of turret 54 through belt 155.

Output hub 148 is in driving engagement with intermediate hub 158 through toothed belt 160. Intermediate hub 158 is in driving engagement with hub 162 connected to chain drive sprocket 38 of lower web conveyor system 30 by toothed belt 164.

Hubs 146, 148, 150, 156, 158, and 162 and belts 152, 155, 160, and 164 include engaging teeth so as to maintain a positive positioned relationship between turrets 28 and 54 and chains 32. This is necessary to establish and maintain register between the formed webs 42 and 62. Motor M-1 drives the lower web conveyor system 30, and upper web retention and advancement mechanism 56 at a constant speed to continuously advance webs 42 and 62 through process zone 27 at a constant rate.

Cross shafts 118 and, therefore, linkages 116 which support and operate tooling carriage 110, are powered by motor M-2. Motor M-2 is connected to gear reduction box 166 which includes two output shafts to which are connected hubs 168 and 170. Hub 168 is drivingly connected by toothed drive belt 171 to hub 172 and one cross shaft 118 connected to linkage 116 associated with upper carriage 110. Drive hub 170 is drivingly connected by toothed drive belt 173 to hub 174 on one cross shaft 118 connected to linkages 116 associated with lower carriage 110.

All four cross shafts 118 drive the linkages 116. The shaft connected to hub 172 for driving upper carriage 110 is connected to a hub 176 on the other cross shaft 118 associated with upper carriage 116 by cross drive belt 178. The shaft connected to hub 174 is connected to a hub 180 on the other cross shaft 118 associated with the lower carriage 116 by a cross drive belt 182. Pluralities of tensioning hubs 184 are provided to maintain engagement between the hubs and belt. The hubs and belts associated with the drive of the carriages are also toothed to insure fixed positional relationships between the carriages and motor M-2 for reasons that will become apparent. The belts used are referred to as HTD toothed belts.

Figure 13:
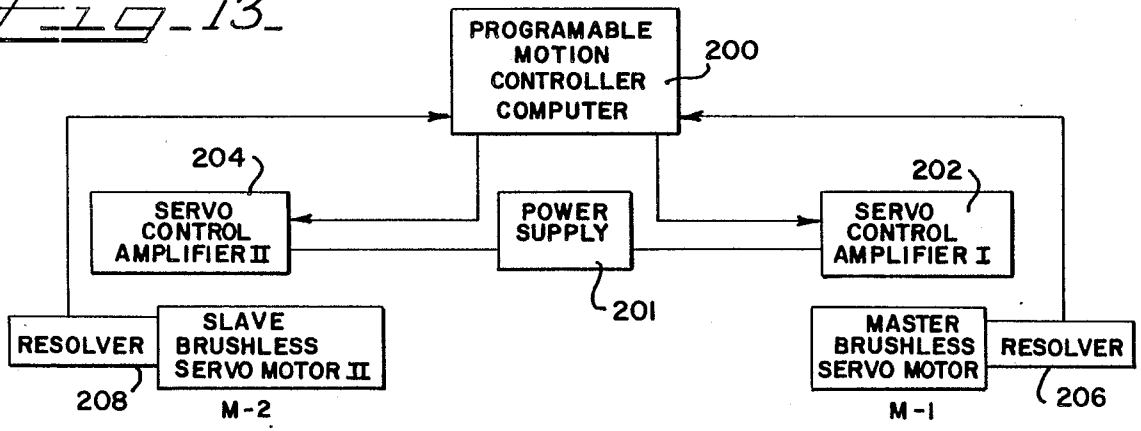
FIG. 13 is a schematic view illustrating the electrical power and electronic control system of the machine of FIG. 1.

FIG. 13 is a schematic of the motor power and control system. Control station 24 includes programable motion controller computer 200 which controls power supplied to motors M-1 and M-2 from power supply 201. Servo control amplifiers 202 and 204 are respectively associated with motors M-1 and M-2. Each receives signals from the motion control computer 200 and delivers appropriate current to the motor windings.

Resolvers 206 and 208 are connected between motors M-1 and M-2 and position controller computer 200. The resolvers supply signals to the computer controller indicative of the positions of the motors.

A suitable programable motor controller computer 200 is a Model 3220 Flexible Automation Controller manufactured by Gould Inc., Cybermatic Controls Division, Pittsburgh, Pa. Suitable servo control amplifiers 202 and 204 are "Cyberline 1000" (trademark of Gould Inc.). These controllers are also manufactured by Gould, Inc. Suitable brushless servo motors M-1 and M-2 are also available from Gould Inc. and include the CGD series, CGP series and the 300 series.

The motors M-1 and M-2 are connected to the web drives and carriage drives by toothed hubs and pulleys. Therefore, a given position of the shafts of the motors during a single cycle shown in FIG. 7 is indicative of the relative positions of the webs and carriages at that point in the cycle. The controller computer 200 is provided with an EPROM memory into which is placed a set of point pairs that identify the position of the shaft of motor M-2 for each position of the shaft motor M-1 through one complete cycle of the tooling carriage 110. Since the webs advance at a constant speed, motor M-1 is established as the master and is driven at constant speed. Motor M-2 is a slave motor and the system is arranged to position the shaft of motor M-2 at a predetermined position for each position of the shaft of motor M-2. Both motors complete each cycle and return to the starting position for the next cycle in the same period of time. The time to complete one cycle is, therefore, established by the master motor M-1.

The points of relative position of the motor shafts is first determined by the required position of tooling carriages 110 relative to web movement throughout the cycle. The point pairs are, in essence, a cam table which determines the required motion of the linkages 116 throughout the cycle to accomplish proper movement of the carriage 110. The number of point pair comparisons utilized will vary dependent on the accuracy of position matching required, and the magnitude of deviation from constant speed of the shaft of motor M-2 required to accomplish the required positional relationship.

In operation, motor M-1 is set by the controller computer 200, through amplifier 202, to rotate at a constant speed. The web forming and advancement mechanism then operates at constant speed to advance the web. As the shaft of motor M-1 rotates, the associated resolver 206 sends a signal to the computer 200 indicative of its position in the cycle. The computer thus senses the position of the webs. The resolver 208, associated with motor M-2, also sends signals to computer 200 indicating its position. The computer determines whether, for the sensed position in the cycle of the shaft of master motor M-1 and, hence, the position of the webs, the position of the shaft of slave motor M-2 and, hence, the position of the carriages, is correct. The amount of deviation and its direction, whether leading or lagging, is recognized by the computer which sends a corrective signal to the servo control amplifier associated with motor M-2. The amplifier 204 adjusts current to motor M-2 in accordance with the signal received to maintain the shaft of the slave motor M-2 appropriately positioned relative to the position of the shaft of master motor M-1.

In an operating example, one-thousand twenty points of comparisons were programmed into the memory. Thus, for each cycle, the computer reads and responds to one-thousand twenty position comparisons to maintain the position of the shaft of motor M-2 relative to the position of shaft of motor M-1.

In the operating example, the web segment acted upon by each separate tooling apparatus 112A, 112B, 112C, was 15¾ inches in length. This web segment pattern was three packages in length, two across. Thus, for each cycle of tooling carriages 110, the webs advanced 15¾ inches. The length of the speed matched travel of the webs and carriages (between points 500 and 535 on FIG. 7) was nine inches. During the next 6¾ inches of web travel, the tooling returned to the point of commencement of speed match (point 500 on FIG. 7).

In the machine described above, the linkages were sized as set forth below with the dimensions reflecting the distances between centers of pivot or revolution. The crank arm 130 was four inches in length from shaft 118 to connection 140. Pivot link 134 was 12.8 inches in length from point 136 to pivotal connection 138. The dimensions of triangular link 132 were 9.9 inches between points 138 and 140, 7.816 inches between points 140 and 142, and 3.256 inches between points 138 and 140. Shaft 118 was spaced vertically from pivot connection 136 a distance of 15.281 inches and axially displaced 9.9 inches.

At a production rate of 360 packages per minute, the webs travel 78.75 feet per minute. Each cycle of the tooling carriages occurs in one second. Considering a speed match increment between the tooling carriages 110 and webs equivalent to approximately 8½ inches of web travel, the tooling is operating upon the web for 0.54 seconds during each cycle. The tooling returns to repeat the cycle on the next adjacent web segment in 0.46 seconds.

The computer 200 was programmed such that a complete cycle represented 17½ revolutions of the shaft of motors M-1 and M-2. At the above production rate, the speed of motor M-1 was 1050 RPM. The incremental speed of motor M-2 varied throughout the cycle from a minimum of 651 RPM to a maximum of 1731 RPM. This variation resulted from computer control of the power input to motor M-2 to cause it to maintain a given shaft position in the cycle relative to the shaft position of the motor M-1 to properly position the linkages 118 and thereby the carriages 110.

Control of relative motor positions against a predetermined and pre-established pattern provides the ability to operate the linkage at varying speeds throughout the cycle. Absent that capability, the linkage, driven at constant input speed, could not maintain the proper positional relationship between the webs and carriages and the packaging operation would not be possible.

Various features of the invention have been particularly shown and described in connection with the illustrated embodiment of the invention, however, it must be understood that these particular arrangements merely illustrate and that the invention is to be given its fullest interpretation within the terms of the appended claims.

We claim:

1. A continuous motion procesing machine comprising:

at least one tooling carriage;

drive linkage including a rotatable power input shaft, said linkage being connected to said carriage to move said carriage in a repetitive cyclic path;

processing tooling carried by said carriage adapted to perform processing steps in a processing zone during an increment of said cycle of carriage movement;

means for supplying at least one web to said processing zone at a constant rate of advancement including a first motor having a rotatable output shaft positionable in a plurality of positions during a predetermined distance of web advancement;

control means connected to said power input shaft to move said carriage through said repetitive cyclic path in a predetermined period of time;

said control means further including means to sense specific positions of said shaft of said first motor and to vary speed of rotation of said power input shaft during said predetermined time period in relation to the position of said shaft of said first motor during said predetermined distance of web advancement.

2. A continuous motion processing machine as claimed in claim 1 further including:

a second motor connected to said power input shaft of said linkage;

said motor having a shaft rotatable to a plurality of positions during said cycle of carriage movement;

said control means controlling the position of said shaft of said second motor in response to the sensed position of said first motor.

3. A continuous motion processing machine as claimed in claim 2 wherein said:

control means include means establishing a predetermined relationship between the position of said shaft of said first motor and the shaft of said second motor during said predetermined distance of web advancement;

said control means controlling the position of said shaft of said second motor based on said predetermined relationship.

4. A continuous motion processing machine as claimed in claim 2 wherein said control means causes said power output shaft to move said carriage through one of said repetitive cycles in a period of time equal to the period of time required for said first motor to be positioned in said plurality of positions during said predetermined distance of web advancement.

5. A continuous motion processing machine as claimed in claim 3 wherein said control means causes said power output shaft to move said carriage through one of said repetitive cycles in a period of time equal to the period of time required for said first motor to be positioned in said plurality of positions during said predetermined distance of web advancement.

6. A continuous motion processing machine as claimed in claim 5 wherein said linkage includes plural pairs of four bar linkages separately supporting said carriage.

7. A continuous motion processing machine as claimed in claim 6 wherein said machine includes two said tooling carriages, said carriages being supported in opposing facing relation on opposite sides of said web.

8. A continuous motion processing machine comprising:

a framework;

conveyor means supported on said framework adapted to travel through a processing zone at a constant rate;

first web supply means on said framework adapted to deliver a first web to said conveyor means to carry said web through said processing zone at a constant rate of advancement said first web supply means including a first motor having a rotatable output shaft positionable in a plurality of positions during a predetermined distance of web advancement;

means to condition said first web to receive product to be packaged;

second web supply means to supply a second web in overlying relation to said first web;

means to connect said webs together for further movement through said zone at said constant rate;

at least one tooling carriage;

drive linkage including a rotatable power input shaft, said linkage being connected to said carriage to move said carriage in a repetitive cyclic path;

processing tooling carried by said carriage adapted to perform processing steps on said webs in said processing zone during an increment of said cycle of carriage movement;

control means connected to said power input shaft to move said carriage through said repetitive cyclic path in a predetermined period of time;

said control means further including means to sense specific positions of said shaft of said first motor and to vary the speed of rotation of said power input shaft during said predetermined time period in relation to the position of said shaft of said first motor during said predetermined distance of web advancement.

9. A continuous motion processing machine as claimed in claim 8:

including a second motor connected to said carriage drive, said carriage drive motor having a rotatable shaft connected to said power input shaft such that the position of said first motor shaft determines the position of said power input shaft;

said control means adapted to position said shaft of said carriage drive motor in response to the position of said shaft of said web drive motor.

10. A continuous motion processing machine as claimed in claim 9 wherein said machine includes:

two tooling carriages; said carriages being supported by said linkage in opposing facing relation on opposite sides of said webs.

* * * * *